United States Patent [19]

Schlueter et al.

[11] 4,256,308

[45] Mar. 17, 1981

[54] GOLF GAME TARGET

[76] Inventors: Roy Schlueter, c/o George Spector, 3615 Woolworth Bldg., 233 Broadway; George Spector, 3615 Woolworth Bldg., 233 Broadway, both of New York, N.Y. 10007

[21] Appl. No.: 48,138

[22] Filed: Jun. 13, 1979

[51] Int. Cl.[3] ..... A63B 69/36

[52] U.S. Cl. ..... 273/177 A; 273/176 AA

[58] Field of Search ..... 273/56, 57, 176 AA, 273/176 B, 177 A, 177 R, 177 B, 127 R

[56] References Cited

U.S. PATENT DOCUMENTS

| | | | |
|---|---|---|---|
| 960,930 | 6/1910 | Huckstra | 273/56 |
| 1,587,295 | 6/1926 | Gammeter | 273/176 AA |
| 3,356,370 | 12/1967 | Larsen | 273/56 X |
| 3,942,801 | 3/1976 | Mintz | 273/176 AB |

*Primary Examiner*—George J. Marlo

[57] ABSTRACT

A game using minimum equipment for playing a sport remotely comparable to golf, the game including nine inverted U-shaped, wire bands for being stuck in the ground so to form bridges under which a player kicks a golf ball with a foot so to score, the game also including break away tees from which a ball is teed off. A vertical leg is integrally connected to each inverted U-shaped band and the leg extends through a base member into the ground. A horizontal pointer is connected to the leg and coacts with indicia on the base member to indicate the extent of movement of the wire bands for scoring purposes.

1 Claim, 5 Drawing Figures

10
13
13
13
13
29
31
11
30
12

13

24
22
27
21
26
23
25

18
16
17

27
28
14
15
26
13
19
20

35

33
34
32
36

32
37
38
INSTRUCTIONS
POOR MAN'S
GOLF
INCLUDES
4 GOLF BALLS
9 HOOPS
100 BREAK AWAY TEES
1 SET
11
100
Breakaway
TEES
12

32

GOLF GAME TARGET

This invention relates generally to game devices.

A principal object of the present invention is to provide a game of golf that can be played with minimum paraphenelia, and which requires no golf clubs.

Another object is to provide a golf game which accordingly will be inexpensive to a purchaser so that it can easily be afforded by most anyone.

Still another object is to provide a poor mans golf game which is certain to appeal to both adults and children as a new variation to the old game of golf.

Figure 1:
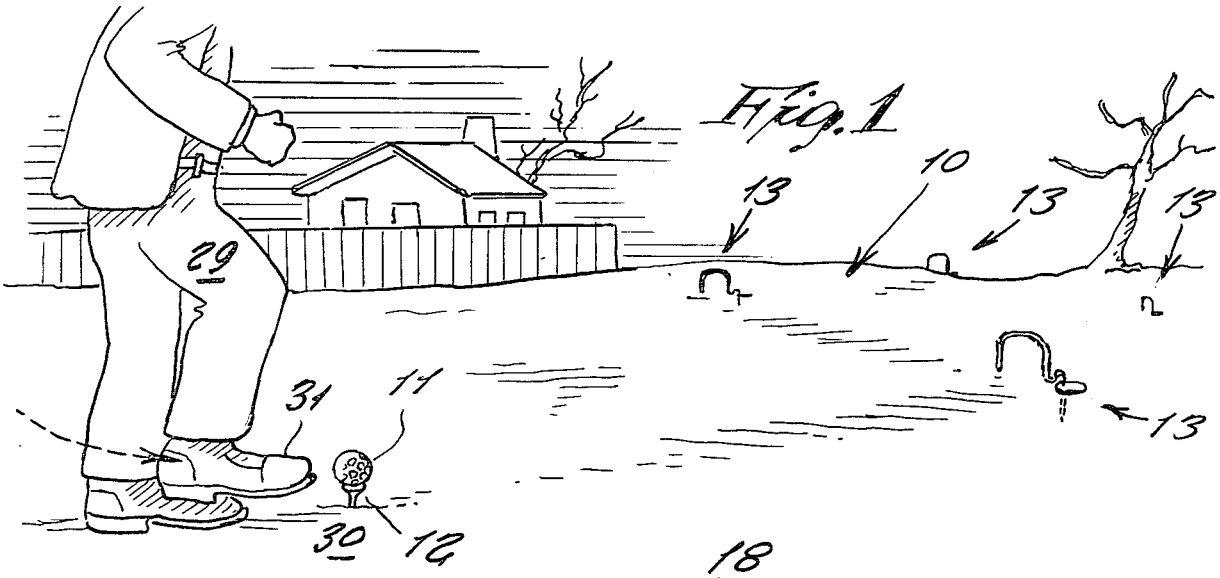
FIG. 1 is a view showing the invention in use playing a game.
Figure 2:
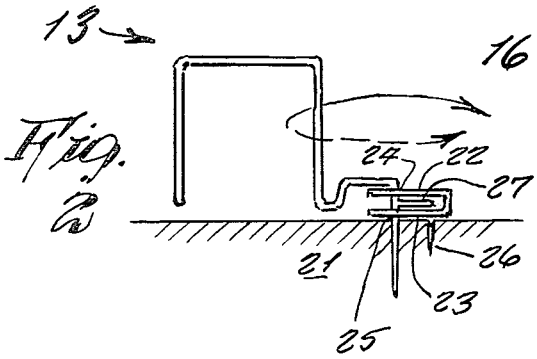
FIG. 2 is a side view of one design of the hole hoop.
Figure 3:
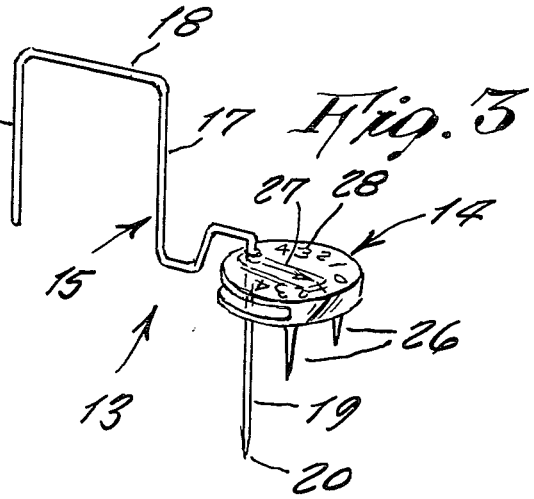
FIG. 3 is a perspective view of the hoop shown in FIG. 2, and showing it to include a dial to record loss of points according to how far the hoop is pivoted by a striking golf ball the misses going clearly through the hoop hole, thus making the game for use in more skilled playing.

Referring now to the drawing in greater detail, and more particularly to FIGS. 1 to 3 thereof, at this time, the reference numeral 10 represents a poor mans golf game set according to the present invention wherein the same comprises four regulation size golf balls 11, a quantity of break away tees 12, and either nine or eighteen hoops 13 that can be used to play either a nine or eighteen "hole" golf game.

Each of the hoops 13 comprise a stationary base 14 anchored on a ground and an inverted, U-shaped hoop member 15 made of bent up, steel, stiff wire that includes parallel, spaced apart legs 16 and 17, interconnected at their upper ends by a crossing leg 18 so to form a bridge under which the golf ball can be rolled.

The leg 17 includes an extension 19 on the end of leg 17 and which has a pointed lower tip 20 for easy insertion into the ground 21, so to hold the hoop in upright, operative use.

The base 14 is molded of hard plastic and includes parallel, spaced apart panels 22 and 23 having holes 24 and 25 through which the hoop extension protrudes rotatably free. Pointed legs 26 are formed on the underside of lower panel 23 so to be pierced into the ground so to anchor the base stationarily. An arrow 27 integral with extension 19 is positioned between the panels and pivots when the hoop member 15 is rotated so that the arrow points to one of the numbers 28 printed in a circular arrangement upon upper panel 22.

In playing this form of the golf game, a person 29 sets up the hoops along the ground so to form a golf course. A golf ball is placed upon a tee at a tee off area 30, and the person kicks the ball with his foot 31, aiming to roll the ball under the first hoop along the course. Scoring can be a same as in a regular golf game. However, in this design of the invention, an additional record may be kept of imprefect shots through the hoops, when if instead of the ball going directly through the hoop, it first strikes either leg 16 or 17 so to cause the hoop member 15 to rotate part way on the base, the amount of rotational displacement of the hoop member being indicated by the numerals 28 the progressively read higher from an initial zero position in each direction. Thus in this form of the invention, this extra scoring feature can be considered when regarding who is a best player in the game.

Figure 4:
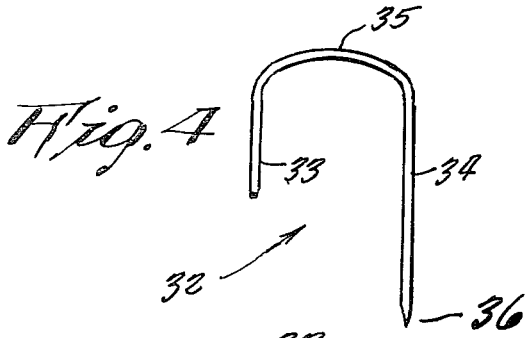
FIG. 4 is a side view of a more simple design of the hoop for a more simple game.
Figure 5:
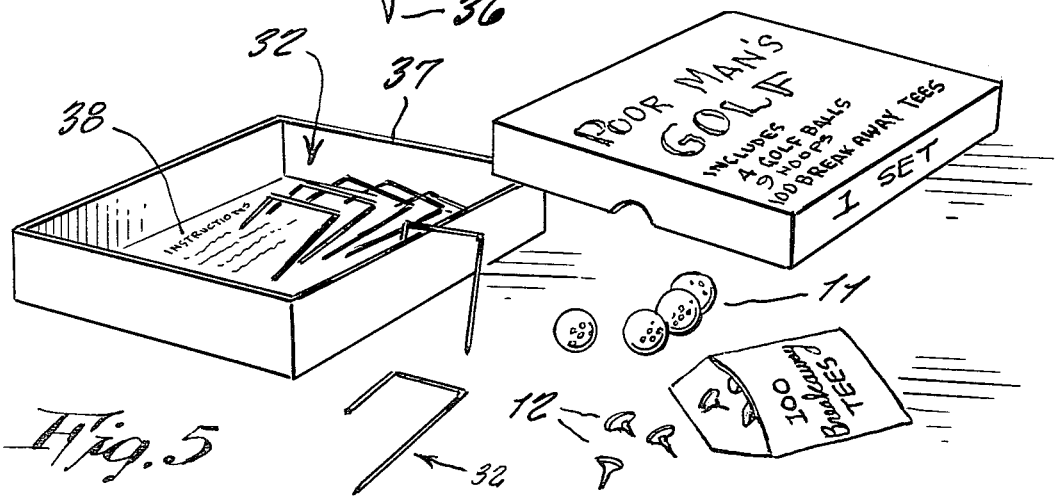
FIG. 5 is a perspective view of a game set using the hoops such as shown in FIG. 4.

In FIGS. 4 and 5, a more simple design of the game is shown wherein each hoop 32 comprises simply a one piece stiff wire bent into the inverted U-shaped described above, and includes parallel spaced apart legs 33 and 34 interconnected at their upper ends by a crossing leg 35. The leg 34 is downwardly longer and includes a pointed lower tip 36 for insertion into the ground.

Leg 35 may be either upwardly arched or straight, as wished by a manufacturer, and as shown.

The game can be retailed in a box 37 having game instructions 38 printed in the box. What is claimed:

1. A hoop device adapted for playing a game using golf balls, said device comprising an inverted U-shaped hoop member in combination with a base for installing said device in the ground, said hoop member and base including coacting means for pivotally mounting said hoop member on said base with the inverted U-shaped hoop member extending laterally from the base overlying the ground, said hoop member being wider than the width of the ball, said base including prongs for ground insertion, said coacting means comprising a leg extending from said hoop member vertically through said base for ground insertion in rotatable fashion, and indicia means on the base and hoop member for indicating degree of rotation of said hoop member relative said base, said indicia means comprising a pointer secured to said rotatable leg and indicia visible on said base to indicate degree of pointer movement.

* * * * *